US006699072B1

(12) United States Patent
Wu

(10) Patent No.: US 6,699,072 B1
(45) Date of Patent: Mar. 2, 2004

(54) CABLE ASSEMBLY

(75) Inventor: Jerry Wu, Irvine, CA (US)

(73) Assignee: Hon Hai PrecisionInd Co., Ltd., Taipei Hsien (TW)

( * ) Notice: Subject to any disclaimer, the term of this patent is extended or adjusted under 35 U.S.C. 154(b) by 0 days.

(21) Appl. No.: 10/316,547

(22) Filed: Dec. 10, 2002

Related U.S. Application Data

(63) Continuation-in-part of application No. 10/278,520, filed on Oct. 22, 2002.

(51) Int. Cl.[7] ..... H01R 13/648
(52) U.S. Cl. ..... 439/608; 439/579
(58) Field of Search ..... 439/608, 108, 439/101, 79, 701, 579, 610, 76.1

(56) References Cited

U.S. PATENT DOCUMENTS 5,924,899 A 7/1999 Paagman
5,993,259 A * 11/1999 Stokoe et al. ..... 439/608
6,083,047 A * 7/2000 Paagman ..... 439/608
6,102,747 A 8/2000 Paagman
6,146,202 A * 11/2000 Ramey et al. ..... 439/608
6,217,364 B1 4/2001 Miskin et al.
6,238,245 B1 * 5/2001 Stokoe et al. ..... 439/608
6,273,762 B1 * 8/2001 Regnier ..... 439/608
6,299,483 B1 * 10/2001 Cohen et al. ..... 439/608
6,380,485 B1 * 4/2002 Seaman et al. ..... 439/579
6,428,344 B1 * 8/2002 Reed ..... 439/579
6,468,110 B2 * 10/2002 Fujino et al. ..... 439/610
6,471,547 B1 * 10/2002 Venaleck et al. ..... 439/608

* cited by examiner

*Primary Examiner*—Gary Paumen
(74) *Attorney, Agent, or Firm*—Wei Te Chung

(57) ABSTRACT

A cable assembly (1) includes an insulating housing (10) defining a number of parallel channels (14) extending in a first direction of the housing and a number of circuit modules (20) received in the housing. Each circuit module includes a circuit board (22) received in a corresponding channel of the housing, a number of cables (23) mechanically and electrically connecting with the circuit board and a cable clamp (25) bonding the cables together. The cable clamp includes a first and a second stamped metallic tapes (251, 252) clamping the cables from opposite sides. A fastening element (40) is inserted into through holes of the cable clamps along the second direction and the cable clamps of the circuit modules are stringed by the fastening element.

14 Claims, 8 Drawing Sheets

CABLE ASSEMBLY

CROSS-REFERENCE TO RELATED APPLICATIONS

This patent application is a continuation-in-part (CIP) of a U.S. patent application Ser. No. 10/278,520, filed on Oct. 22, 2002, entitled "ELECTRICAL CABLE ASSEMBLY" and assigned to the same assignee with this patent application.

BACKGROUND OF THE INVENTION

1. Field of the Invention

The present invention relates to a cable assembly, and particularly to a cable assembly having a plurality of circuit boards for high speed signal transmission.

2. Description of Related Art

With the development of communication and computer technology, high density electrical connectors are desired to construct a large number of signal transmitting paths between two electronic devices. Each of these electrical connectors provides a plurality of circuit boards to thereby achieve improved signal transmission of different electrical characteristics through the connector. Such high density electrical connectors, such as cable assemblies, are widely used in internal connecting systems of severs, routers and the like requiring high speed data processing and communication.

U.S. Pat. No. 6,217,364, issued to Miskin et al., discloses a cable assembly including an insulating housing formed by a pair of substantially identical housing halves and an electrical cable with a plurality of wires terminated to conductive terminals overmolded in a plurality of thin flat wafers. The housing halves combines to define an interior cavity having a front opening and a rear opening. The wafers are closely juxtaposed in a parallel array and are positioned within the interior cavity of one of the housing halves such that the cable projects out of the rear opening of the cavity. The other housing half is then to completely enclose the cable and wafer subassembly. However, the cable and wafer subassembly are retained in the housing by securing the housing halves together through bolts and nuts, thereby complicating the assemblage of the cable assembly. Furthermore, an engagement of the housing halves is easy to become loose due to vibration during the transportation and other matters, whereby the cable and the wafer subassembly cannot be stably retained in the housing. Thus, an electrical connection is adversely affected between the cable assembly and a complementary connector.

U.S. Pat. Nos. 5,924,899 and 6,102,747, both issued to Paagman, each disclose a cable assembly. Referring to FIGS. 4*a*–4*c* and 5*a*–5*c* of the '899 patent, the cable assembly includes an insulating housing with a plurality of parallel slots defined therein and a plurality of modules received in the slots of the housing. Each module includes a circuit substrate, a receptacle carrier having a plurality of fork contacts at one end of the substrate and an insulation displacement contact (IDC) carrier at the other end of the substrate opposite the terminal carrier. The insulation displacement carrier has insulation displacement contacts connecting with conductors of corresponding cables. The modules each are retained in the housing through an interference fit with the housing. When the cable assembly is required to disengage from a complementary connector, a pulling force is exerted on an exposed end of the cable for releasing the engagement between the cable assembly and the complementary connector. However, the modules may be pulled back with regard to the housing, thereby adversely affecting an electrical engagement when the cable assembly mates with the complementary connector again. Furthermore, an additional device is employed to bond the cables together, thereby increasing the cost of the production.

Hence, an improved Cable assembly is required to overcome the disadvantages of the related art.

SUMMARY OF THE INVENTION

Accordingly, a first object of the present invention is to provide a cable assembly having strain relief means for substantially resisting a pulling force exerted on a cable thereof.

A second object of the present invention is to provide a cable assembly having a plurality of individual circuit boards reliably retained in an insulating housing thereof.

A third object of the present invention is to provide a cable assembly having a grounding plate for reducing crosstalk between adjacent cables thereof.

In order to achieve the objects set forth, a cable assembly includes an insulating housing defining a number of parallel channels extending in a first direction of the housing and a number of circuit modules received in the housing. Each circuit module includes a circuit board received in a corresponding channel of the housing, a number of cables mechanically and electrically connecting with the circuit board and a cable clamp bonding the cables together. The cable clamp includes a first and a second stamped metallic tapes clamping the cables from opposite sides. A fastening element is inserted into through holes of the cable clamps along the second direction and the cable clamps of the circuit modules are stringed by the fastening element.

Other objects, advantages and novel features of the invention will become more apparent from the following detailed description when taken in conjunction with the accompanying drawings.

DETAILED DESCRIPTION OF THE INVENTION

Figure 1:
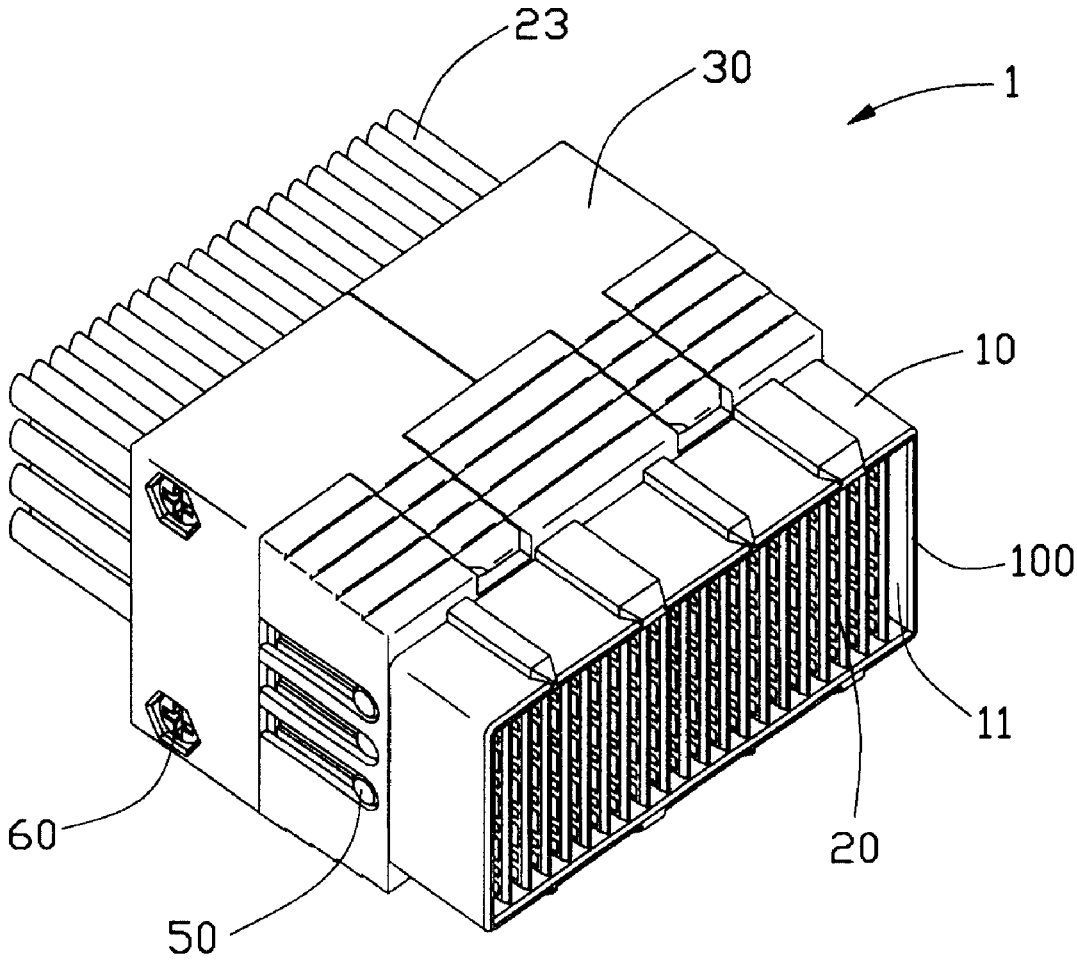
FIG. 1 is a perspective view of a cable assembly in accordance with the present invention.
Figure 2:
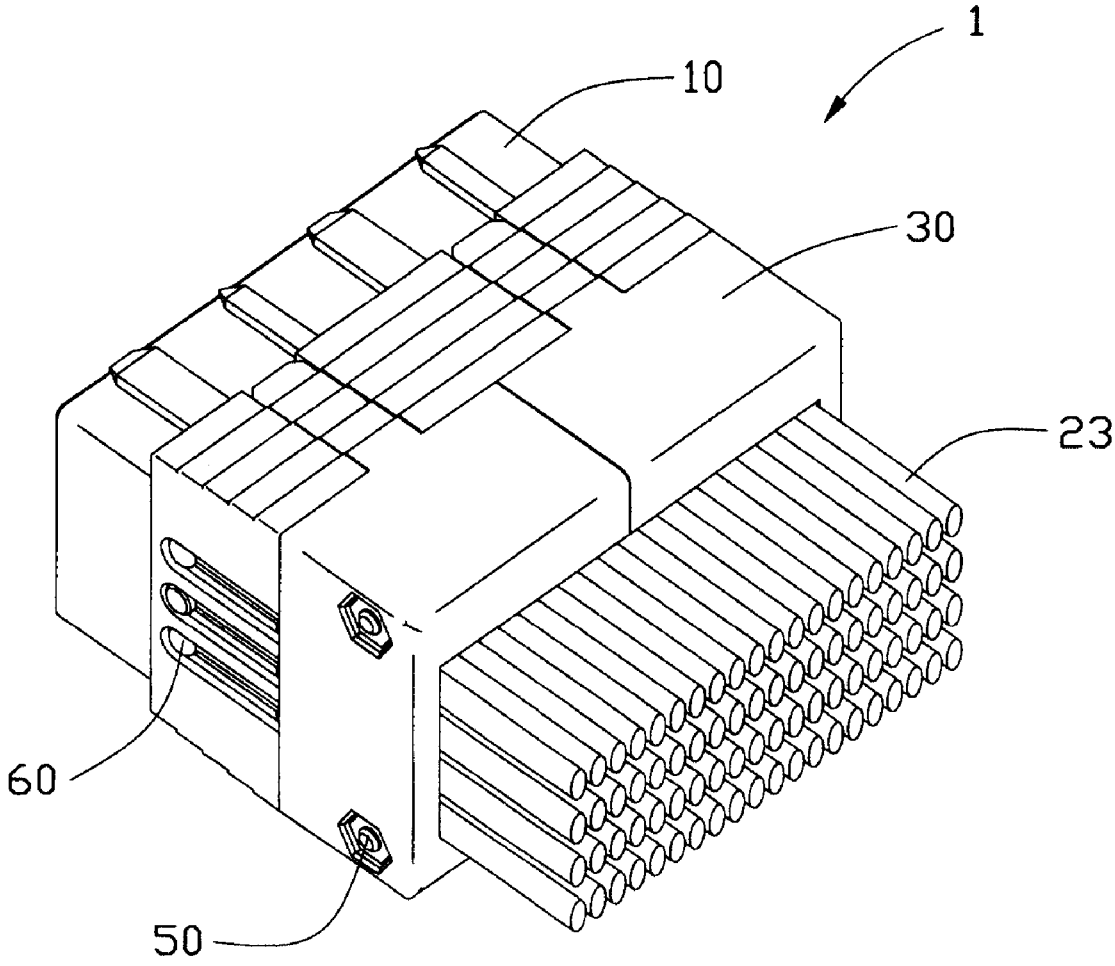
FIG. 2 is a view similar to FIG. 1 but taken from a different perspective.

Referring to FIGS. 1 and 2, a cable assembly 1 in accordance with the present invention comprises a front insulating housing 10, a plurality of circuit modules 20 received in the front housing 10 and a two-piece tear cover 30 together with the front housing 10 for retaining the circuit modules 20.

Figure 3:
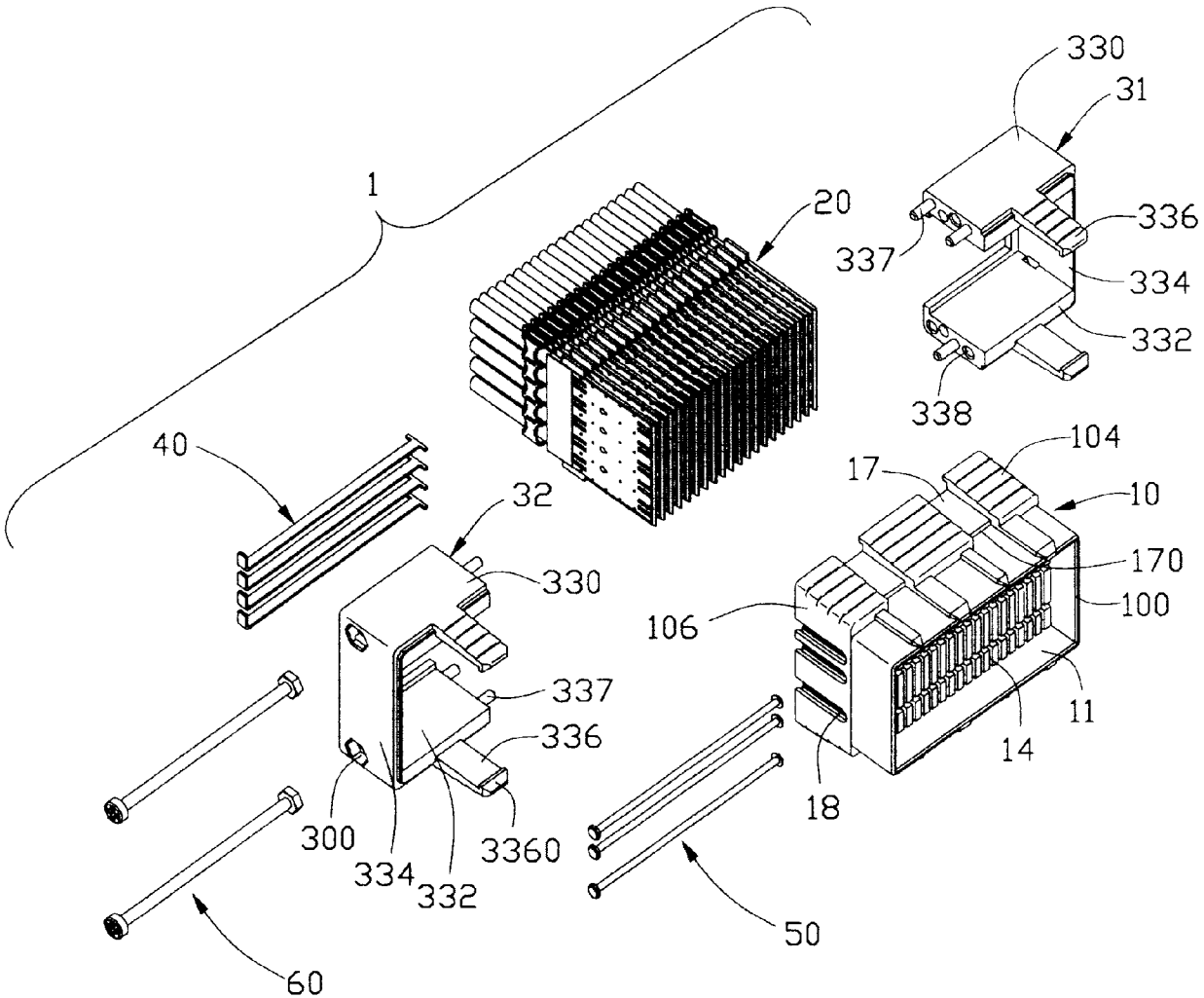
FIG. 3 is an exploded view of the cable assembly of FIG. 1.
Figure 4:
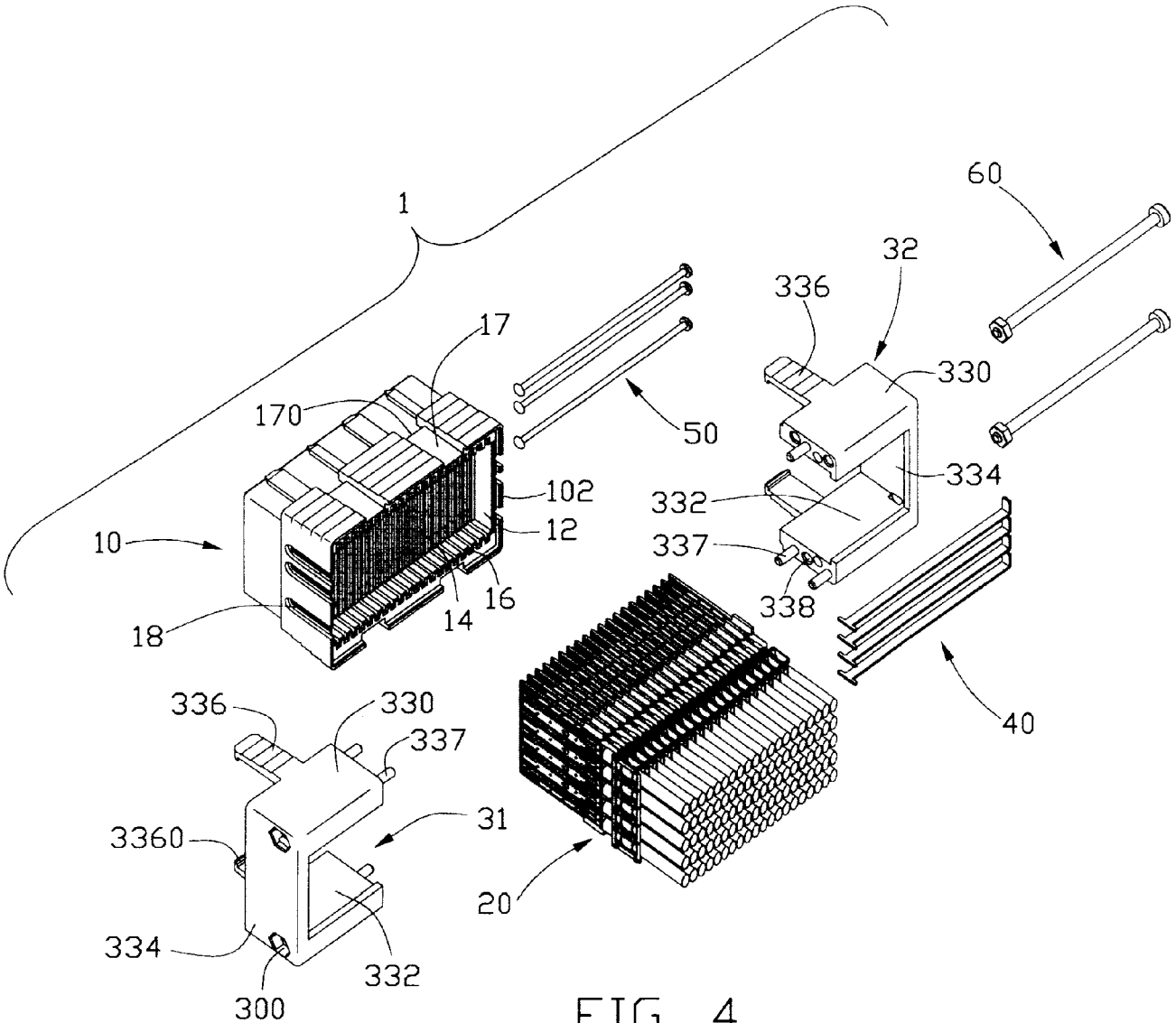
FIG. 4 is a view similar to FIG. 3 but taken from a different perspective.
Figure 5:
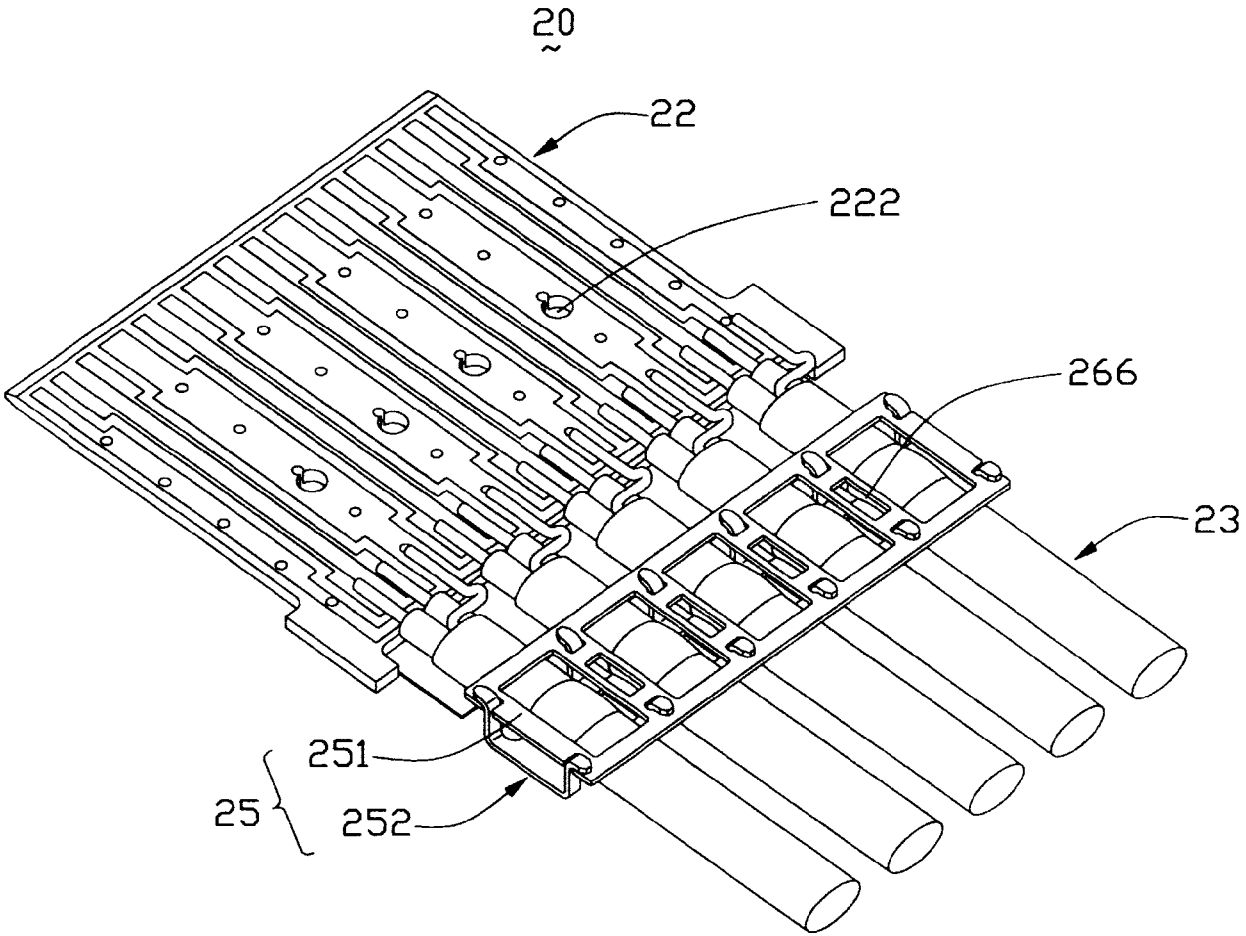
FIG. 5 is an enlarged perspective view of a circuit module of the cable assembly shown in FIG. 3.
Figure 6:
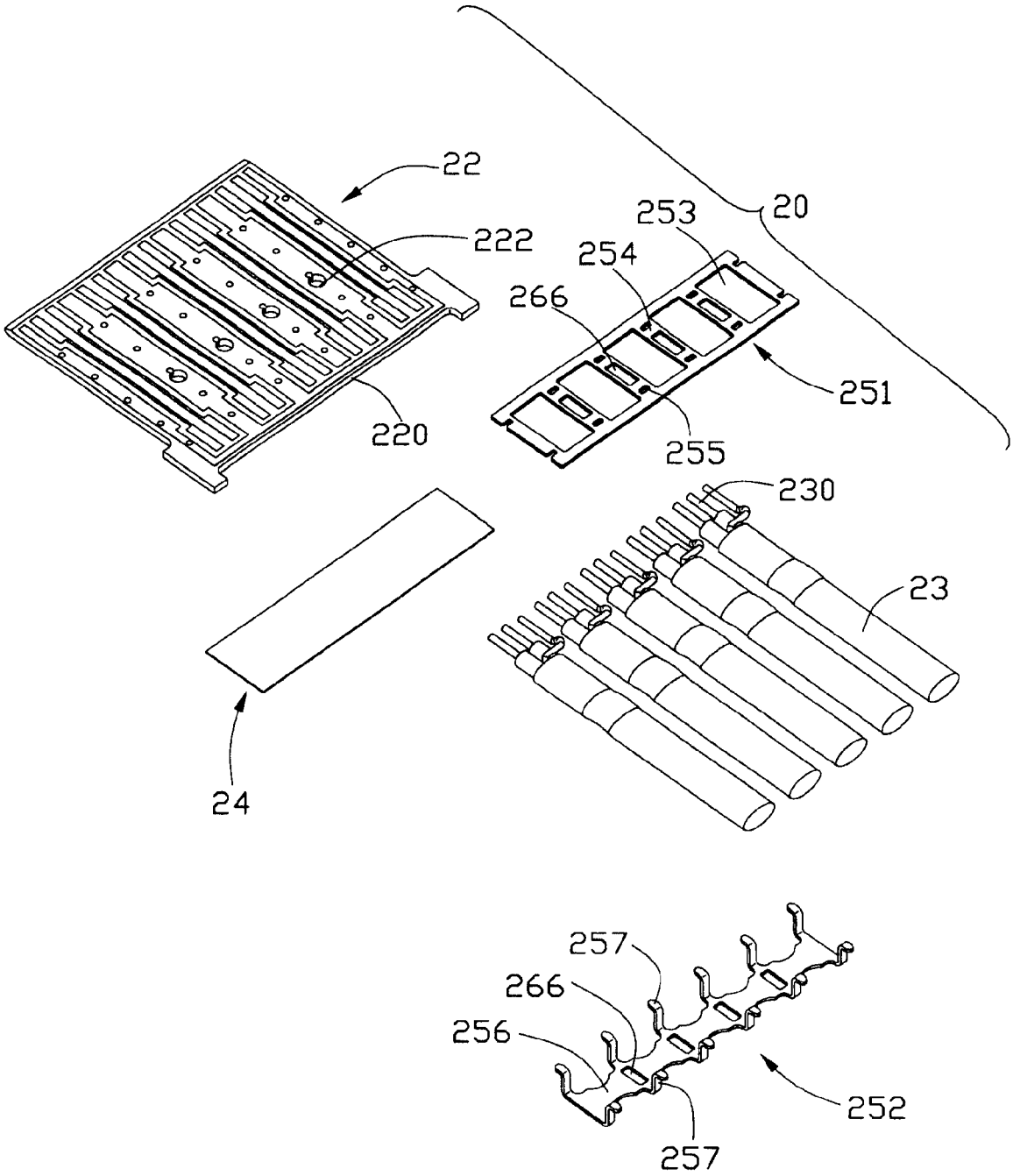
FIG. 6 is an exploded perspective view of the circuit module of FIG. 5.
Figure 7:
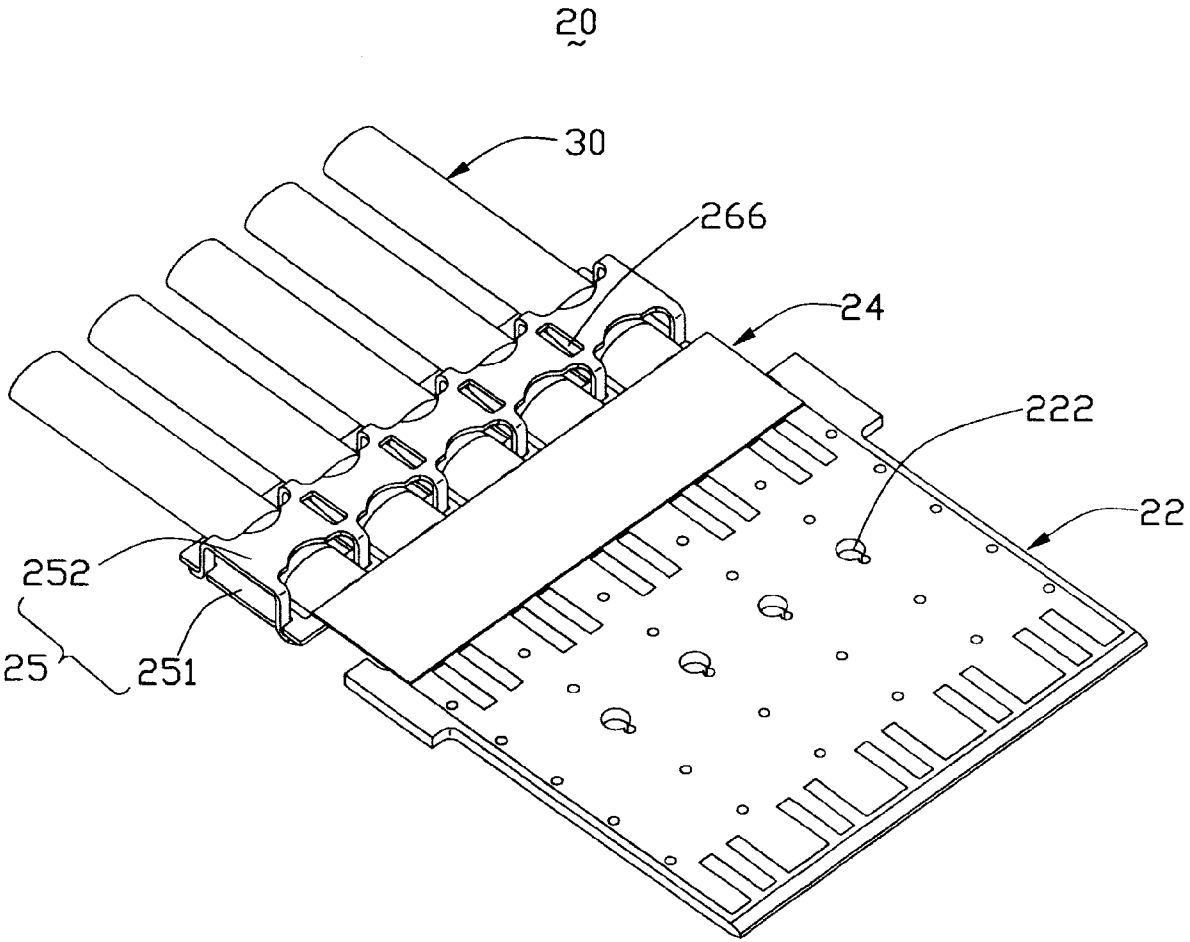
FIG. 7 is a view similar to FIG. 5 but taken from a different perspective.
Figure 8:
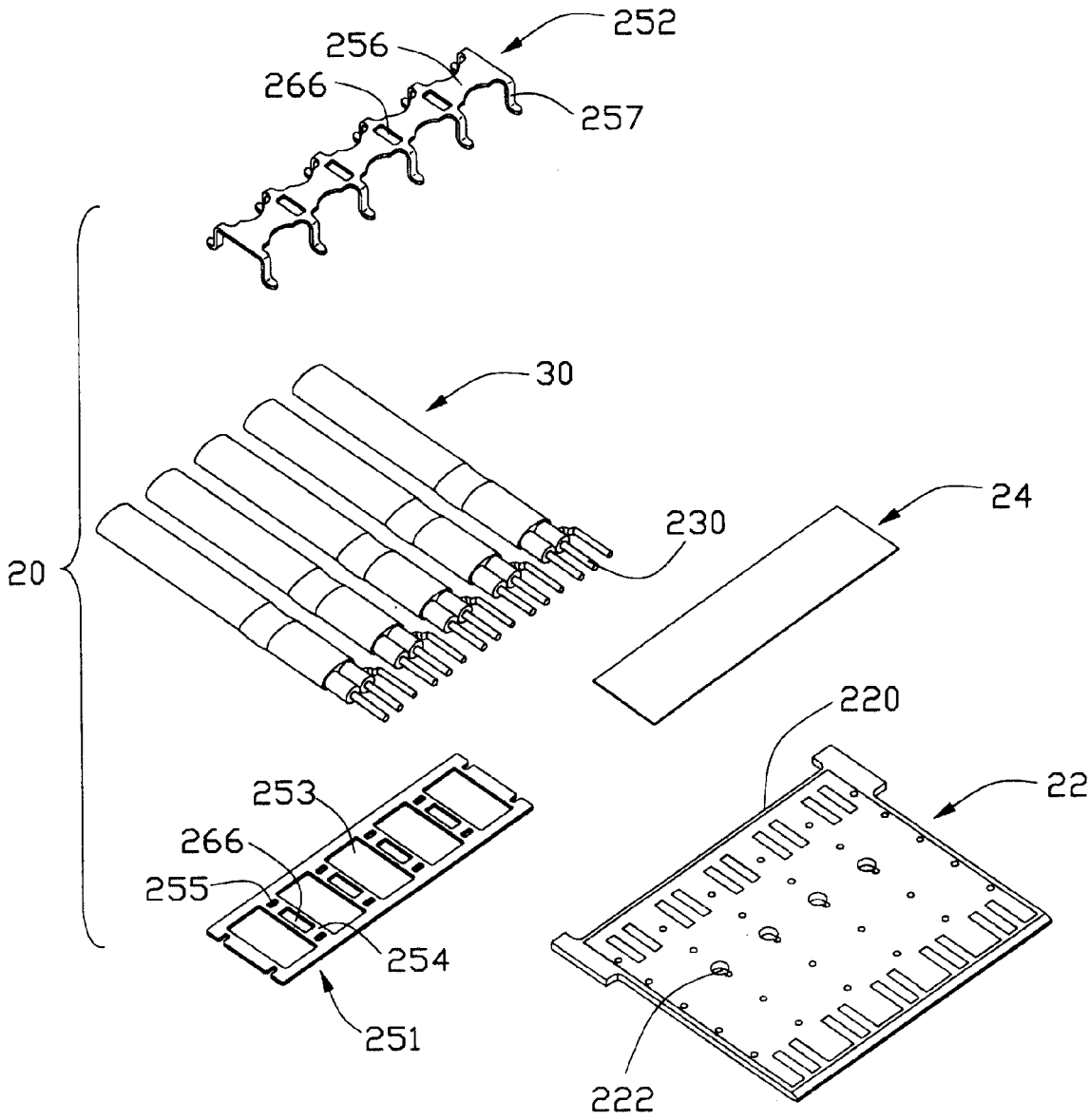
FIG. 8 is a view similar to FIG. 6 but taken from a different aspect.

Referring to FIGS. 3 and 4, the front housing 10 is generally in a rectangular shape. The housing 10 has a front mating port 11 in a front mating face 100 which faces a complementary connector (not shown) and a rear chamber 12 in a rear face 102. The housing 10 defines a plurality of parallel channels 14 extending in a front-to-back direction communicating with the front mating port 11 and the rear chamber 12 and a plurality of grooves 16 which are aligned with the channels 14. The housing 10 further defines a plurality of recesses 17 respectively in a top face 104 and a bottom face (not labeled) and a plurality of cavities 170 recessed downwardly from the corresponding recesses 17. An aperture 18 is defined through opposite side faces 106 of the housing 10 in a direction substantially perpendicular to the extending direction of the channels 14.

Each one of the circuit modules 20 is identical in structure and an exemplary one is shown in FIGS. 5–8. Each circuit module 20 comprises a circuit board 22 and a plurality of cables 23 electrically connecting with the circuit board 22. The circuit board 22 includes a dielectric substrate made of conventional circuit board substrate material, such as FR4, a plurality of conductive signal traces (not labeled) on one side of the substrate for providing electrical paths through the cable assembly 1 and a plurality of grounding traces (not labeled) on both sides of the substrate for grounding purpose. The circuit board 22 defines a cutout 220 at a rear end thereof and a through hole 222 aligned with the aperture 18 of the housing 10. The cables 23 of each circuit module 20 are arranged in a common plane and have conductive cores 230 soldered to the signal traces on the circuit board 22.

The circuit module 20 further comprises a grounding plate 24 and a cable clamp 25 adapted for being applied to the cables 23. The grounding plate 24 is preferably a copper tape and is located above the conductive cores 230 that are soldered onto the circuit board 22 to provide EMI shielding function to the conductive cores 230.

In the preferred embodiment of the present invention, the cable clamp 25 includes a first tape 251 and a second tape 252 both are stamped and formed from metal tapes. The first tape 251 defines a plurality of rooms 253 and forms a plurality of bridges 254 between adjacent rooms 253. Each bridge 254 defines a pair of openings 255 at opposite ends thereof. The second tape 252 includes a body portion 256 and two rows of tails 257 upwardly extending from two opposite sides of the body portion 256. The first and second tapes 251, 252 clamp ends of the cables from opposite sides with the tails 257 of the second tape 252 being locked in corresponding openings 255 of the first tape 251. The ends of the cables 23 are depressed by the body portion 256 of the second tape 252 such that they are partially into corresponding rooms 253 of the first tape 251. The depression rends impedance of the cables drop a lot, for example, from 100 Ω to 80 Ω. The first and second tapes 251, 252 further defines a number of through holes 266 which are aligned with corresponding gaps 27 between adjacent cables 23.

Referring back to FIGS. 3 and 4, the rear cover 30 comprises a split body having a first half 31 and a second half 32. Each half 31, 32 has a top panel 330, a bottom panel 332 and a side panel 334 formed between the top panel 330 and the bottom panel 332. Each half 31, 32 forms a pair of latches 336 extending forwardly from front edges of the top and bottom panels 330, 332, a plurality of dowel pins 337 and corresponding holes 338 for joining the first half 31 and the second half 32 together. Each latch 336 has a projection 3360 formed at a free end thereof. The rear cover 30 defines a bore 300 extending through the side panels 334 thereof. It should be noted that any other suitable connecting means may be employed to connect the first and second halves 31, 32. This split design helps to facilitate the assembly and installation of the cover 30 on to the housing 10 over the circuit modules 20.

In assembly, the circuit modules 20 are inserted into the channels 14 of the housing 10 from the rear face 102 until the circuit boards 22 arrives at a position in which front ends of the circuit boards 22 are substantially adjacent to the front mating face 100 of the housing 10. The circuit boards 22 are received in the channels 14 with top and bottom ends retained in the grooves 16. A first fastening element 40 is inserted into the through holes 266 of the cable clamps 25 for locking the circuit modules 20 together for strain relief purpose. A second fastening element 50 is inserted into the through holes 222 of the circuit boards 22 through the aperture 18 of the housing 10. The second fastening element 50 is further fastened to the housing 10 for keeping the circuit modules 20 in their original position rather than be pushed back when the cable assembly 1 mates with the complementary connector, thereby stably retaining the circuit modules 20 in the housing 10.

The first and second halves 31, 32 of the cover 30 are assembled to the housing 10 with the projections 3360 of the latches 336 mechanically engage the cavities 170 of the recesses 17. At the same time, the first and second halves 31, 32 are connected by an interference engagement between the dowel pins 337 and the corresponding recesses 338. The cover 30 is disposed around the cable clamps 25 of the circuit modules 20. A third fastening element 60 is inserted into the bore 300 of the cover 30 for retaining the cable clamps 25 in the cover 30.

It is noted that since the circuit modules 20 are stably retained between the front housing 10 and the rear cover 30 via the second and third fastening elements 50, 60, a reliable electrical engagement is ensured between the cable assembly 1 and the complementary connector. It is also noted that the cables 23 are clamped by the cable clamps 25, more importantly, the cable clamps 25 are locked together via the first fastening element 40, whereby a pulling force exerted on the cables 23 can be substantially released.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

an insulating housing defining a plurality of parallel channels extending in a first direction of the housing;

a plurality of circuit modules each including a circuit board received in a corresponding channel of the housing, a plurality of cables mechanically and electrically connecting with the circuit board and a cable clamp bonding the cables together, the cable clamp including a first and a second stamped metallic tape clamping the cables from opposite sides, each cable clamp defining at least one through hole extending in a second direction substantially perpendicular to the first direction of the housing; and a first fastening element inserted into the through holes of the cable clamps along the second direction and bonding the circuit modules together via the cable clamps.

2. The cable assembly as claimed in claim 1, wherein each of the first stamped metallic tapes defines a plurality of openings and each of the second stamped metallic tapes forms a corresponding number of tails that are fixed into the openings to joining the first and second stamped metallic tapes together.

3. The cable assembly as claimed in claim 2, wherein the first stamped metallic tape defines a plurality of rooms and wherein the cables are partially depressed into the rooms by the second stamped metallic tape.

4. The cable assembly as claimed in claim 1, wherein the circuit module further includes a grounding plate located above conductive cores of the cables.

5. The cable assembly as claimed in claim 4, wherein the grounding plate is a copper tape.

6. The cable assembly as claimed in claim 1, wherein the housing defines an aperture extending through the housing in the second direction, and the circuit board of each circuit module defines a through hole aligned with the aperture of the housing.

7. The cable assembly as claimed in claim 6 further including a second fastening element inserted into the through holes of the circuit boards through the aperture of the housing, the circuit boards being stringed by the second fastening element and the second fastening element being fastened to the housing, thereby retaining the circuit boards in the housing.

8. A cable assembly, comprising:

an insulating housing defining a plurality of parallel channels extending in a first direction of the housing and an aperture extending through the housing in a second direction substantially perpendicular to the first direction;

a plurality of circuit modules each including a circuit board received in a corresponding channel of the housing and a plurality of cables electrically connecting with the circuit board, each circuit board defining a through hole aligned with the aperture of the housing;

a cover including first and second halves joined together and being attached to the housing, the cover defining a bore extending through the first and second halves in the first direction; and first and second fastening elements respectively inserted into the through holes of the circuit boards through the aperture of the housing and the bore of the cover for retaining the circuit modules between the housing and the cover.

9. The cable assembly as claimed in claim 8, wherein the circuit module further includes a cable clamp bonding the cables together, the cable clamp defining a through hole extending in a fourth direction parallel with the first direction.

10. The cable assembly as claimed in claim 9 further including a third fastening element inserted into the through holes of the cable clamps along the second direction, the cable clamps being stringed by the third fastening element.

11. The cable assembly as claimed in claim 10, wherein each circuit module further includes a grounding plate located above conductive cores of the cables.

12. The cable assembly as claimed in claim 11, wherein the grounding plate is a copper tape.

13. A cable assembly comprising:

an insulative housing receiving a plurality of juxtaposed printed circuit boards therein, each of said printed circuit board extending along a lengthwise direction while said printed circuit boards side by side arranged with one another along a lateral direction perpendicular to said lengthwise direction;

a plural sets of cables extending along a front-to-back direction perpendicular to both said lengthwise direction and said lateral direction, and each set being commonly mounted on a rear edge portion of each of said printed circuit board, said plural sets of cables being arranged in a matrix manner for a cross-section thereof;

a plurality of clamps each extending along said lengthwise direction to retain the corresponding set of cables therein, and a plurality of fastening elements extending along said lateral direction to grip said plurality of clamps, so as to retain all the matrix type cables in a stable manner.

14. The assembly as claimed in claim 13, wherein each of said cables is segregated from the adjacent others in said lateral direction by said clamps while in said lengthwise direction by said fastening elements.

* * * * *